US010916197B1

(12) United States Patent
Zhang

(10) Patent No.: US 10,916,197 B1
(45) Date of Patent: Feb. 9, 2021

(54) PIXEL COMPENSATION CIRCUIT AND DISPLAY PANEL

(71) Applicant: Shenzhen China Star Optoelectronics Semiconductor Display Technology Co., Ltd., Guangdong (CN)

(72) Inventor: Xiaodong Zhang, Guangdong (CN)

(73) Assignee: Shenzhen China Star Optoelectronics Semiconductor Display Technology Co., Ltd., Guangdong (CN)

( * ) Notice: Subject to any disclaimer, the term of this patent is extended or adjusted under 35 U.S.C. 154(b) by 0 days.

(21) Appl. No.: 16/646,568

(22) PCT Filed: Feb. 14, 2020

(86) PCT No.: PCT/CN2020/075250
§ 371 (c)(1),
(2) Date: Mar. 12, 2020

(51) Int. Cl.
*G09G 3/3258* (2016.01)
*G09G 3/20* (2006.01)
*G09G 3/3233* (2016.01)

(52) U.S. Cl.
CPC ..... *G09G 3/3258* (2013.01); *G09G 3/2007* (2013.01); *G09G 3/3233* (2013.01); *G09G 2300/043* (2013.01); *G09G 2300/0426* (2013.01); *G09G 2320/0233* (2013.01); *G09G 2320/045* (2013.01)

(58) Field of Classification Search
CPC .. G09G 3/3258; G09G 3/2007; G09G 3/3233; G09G 2300/0426; G09G 2300/043; G09G 2320/0233; G09G 2320/045
USPC ..... 345/214
See application file for complete search history.

(56) References Cited

U.S. PATENT DOCUMENTS

2014/0168194 A1* 6/2014 Kong ..... H01L 29/78645 345/212
2015/0123558 A1* 5/2015 Toyomura ..... G09G 3/3233 315/240
2016/0042694 A1* 2/2016 Lim ..... G09G 3/3233 345/78
2017/0337875 A1* 11/2017 Jeon ..... G09G 3/3233
2018/0047333 A1* 2/2018 Nie ..... G09G 3/3258
2018/0144685 A1* 5/2018 Gong ..... H01L 27/3262
2018/0233082 A1* 8/2018 Wang ..... G09G 3/3258
2019/0066587 A1* 2/2019 Han ..... H01L 27/1218
2019/0164476 A1* 5/2019 Feng ..... H01L 27/3274
2020/0258452 A1* 8/2020 Feng ..... H01L 27/3262

* cited by examiner

*Primary Examiner* — Tom V Sheng
(74) *Attorney, Agent, or Firm* — Mark M. Friedman

(57) ABSTRACT

The present application discloses a pixel compensation circuit and a display panel. By adopting a double-gate structure transistor as a driving transistor, a top gate and a bottom gate can respectively regulate channels to realize a dynamic adjustment of a threshold voltage of the driving transistor. Detection of the threshold voltage by a diode-connect mode can be realized by controlling the driving transistor. Real-time compensation of the threshold voltage can be realized, and compensation of a positive drift and a negative drift of the threshold voltage can also be realized, which effectively improves uniformity of image display under a same grayscale.

20 Claims, 5 Drawing Sheets

PIXEL COMPENSATION CIRCUIT AND DISPLAY PANEL

FIELD OF APPLICATION

The present application is related to the field of display technology, and specifically to a pixel compensation circuit and a display panel.

BACKGROUND OF APPLICATION

Active-matrix organic light-emitting diode (AMOLED) display devices are display devices that use current to drive organic light-emitting diode (OLED) devices to emit light to form images. Compared to traditional liquid crystal displays (LCDs), AMOLEDs, as a new generation of display technology, have higher contrast, faster response times, and wider viewing angles. Hence, they are widely used in the field of smartphone and have expanded into the field of smart TVs and wearable devices through continuous development.

In terms of driving methods, unlike traditional voltage-driven LCDs, AMOLEDs are current-driven devices and are sensitive to variation of electrical properties of thin-film transistors (TFTs), so drifts of threshold voltages (Vth) of the TFTs affect uniformity and accuracy of display images. Currently, small and medium-sized panels based on low-temperature poly-silicon (LTPS) technology generally use 7T1C internal compensation circuits to compensate threshold voltage drifts, thereby improving display images.

SUMMARY OF APPLICATION

Please refer to FIG. 1, which is a circuit diagram of a current 7T1C internal compensation circuit. In the current 7T1C internal compensation circuit, seven thin-film transistors (TFTs) all adopt P-type TFTs. M2 TFT adopts a diode-connect mode to capture a threshold voltage to achieve internal compensation of the threshold voltage. VDD is a driving voltage, VI is a initialization voltage, VSS is a common voltage, Data (m) is a m-th data line, Scan (n) is a scan signal transmitted by a n-th first scan line, Scan (n−1) is a scanning signal transmitted by a (n−1)-th first scan line, EM (n) is a light-emitting control signal transmitted by a n-th light-emitting control line, and Xscan (n) is a scan signal transmitted by a n-th second scan line. However, the internal compensation circuit that the TFTs adopt the diode-connect mode has a small compensation of the threshold voltage range of the internal compensation circuit, and it cannot compensate a case that the threshold voltage is positive, so that effects of compensation are different under different gray levels.

A pixel compensation circuit and a display panel provided by an embodiment of the present application can compensate a threshold voltage under a same gray scale, improve uniformity of panel display, and can achieve a compensation capability when the threshold voltage is a positive value.

An embodiment of the present application provides the pixel compensation circuit, which includes a driving transistor and a light-emitting device, and further includes an initialization unit, a data writing unit, a compensation unit, and a light-emitting control unit. The driving transistor includes a P-type thin-film transistor with a double-gate structure, a bottom gate thereof is electrically connected to a first node, a top gate thereof is electrically connected to a second node, a first electrode thereof is configured to receive a driving voltage, and a second electrode thereof is electrically connected to a third node. The initialization unit is electrically connected to the first node for transmitting an initialization voltage to the first node during an initialization phase to adjust a threshold voltage of the driving transistor to a positive value. The data writing unit is electrically connected to the second node for transmitting a reference voltage to the second node during a compensation phase and transmitting a data voltage to the second node during a data writing phase. The compensation unit includes a fourth transistor, a first capacitor, and a second capacitor. A gate of the fourth transistor is configured to receive a third scan signal, a first electrode thereof is electrically connected to the first node, and a second electrode thereof is electrically connected to the third node. The first capacitor is respectively electrically connected to the first electrode of the driving transistor and the first node, and the second capacitor is respectively electrically connected to the first electrode of the driving transistor and the second node. The compensation unit is configured to control the driving transistor to form a diode-connect mode during the compensation phase to compensate the threshold voltage of the driving transistor to a preset value according to the reference voltage and the driving voltage. The light-emitting control unit is respectively electrically connected to the third node and the light-emitting device for controlling the light-emitting device to emit light under driving of the driving transistor during an emission phase.

An embodiment of the present application provides the pixel compensation circuit, which includes a driving transistor and a light-emitting device, and further includes an initialization unit, a data writing unit, a compensation unit, and a light-emitting control unit. The driving transistor includes a double-gate structure, a bottom gate thereof is electrically connected to a first node, a top gate thereof is electrically connected to a second node, a first electrode thereof is configured to receive a driving voltage, and a second electrode thereof is electrically connected to a third node. The initialization unit is electrically connected to the first node for transmitting an initialization voltage to the first node during an initialization phase to adjust a threshold voltage of the driving transistor to a positive value. The data writing unit is electrically connected to the second node for transmitting a reference voltage to the second node during a compensation phase and transmitting a data voltage to the second node during a data writing phase. The compensation unit is respectively electrically connected to the first node, the second node, the third node, and the first electrode of the driving transistor for controlling the driving transistor to form a diode-connect mode during the compensation phase to compensate the threshold voltage of the driving transistor to a preset value according to the reference voltage and the driving voltage. The light-emitting control unit is respectively electrically connected to the third node and the light-emitting device for controlling the light-emitting device to emit light under driving of the driving transistor during an emission phase.

An embodiment of the present application provides the display panel, which includes an array substrate. The array substrate includes a pixel compensation circuit. The pixel compensation circuit includes a driving transistor and a light-emitting device, and further includes an initialization unit, a data writing unit, a compensation unit, and a light-emitting control unit. The driving transistor includes a double-gate structure, a bottom gate thereof is electrically connected to a first node, a top gate thereof is electrically connected to a second node, a first electrode thereof is configured to receive a driving voltage, and a second electrode thereof is electrically connected to a third node. The initialization unit is electrically connected to the first node for transmitting an initialization voltage to the first node during an initialization phase to adjust a threshold voltage of the driving transistor to a positive value. The data writing unit is electrically connected to the second node for transmitting a reference voltage to the second node during a compensation phase and transmitting a data voltage to the second node during a data writing phase. The compensation unit is respectively electrically connected to the first node, the second node, the third node, and the first electrode of the driving transistor for controlling the driving transistor to form a diode-connect mode during the compensation phase to compensate the threshold voltage of the driving transistor to a preset value according to the reference voltage and the driving voltage. The light-emitting control unit is respectively electrically connected to the third node and the light-emitting device for controlling the light-emitting device to emit light under driving of the driving transistor during an emission phase.

The pixel compensation circuit of the present application adopts the double-gate structure transistor as the driving transistor, so that the top gate and the bottom gate can respectively regulate channels to realize a dynamic adjustment of the threshold voltage of the driving transistor. Detection of the threshold voltage by a diode-connect mode can be realized by controlling the driving transistor. Real-time compensation of the threshold voltage can be realized, and compensation of a positive drift and a negative drift of the threshold voltage can also be realized. A range of the compensation of the threshold voltage is effectively broadened, and the compensation of the threshold voltage in different threshold voltage drifts under a same grayscale is realized, thereby effectively improving the uniformity of image display under the same grayscale and increasing service life of the panel display. In addition, a circuit structure of the pixel compensation circuit of the present application is simple and requires fewer TFTs, which facilitates in-plane integration.

DESCRIPTION OF DRAWINGS

In order to describe technical solutions in the present application clearly, drawings to be used in the description of embodiments will be described briefly below. Obviously, drawings described below are only for some embodiments of the present application, and other drawings may be obtained by those skilled in the art based on these drawings without creative efforts.

DETAILED DESCRIPTION OF PREFERRED EMBODIMENTS

Figure 1:
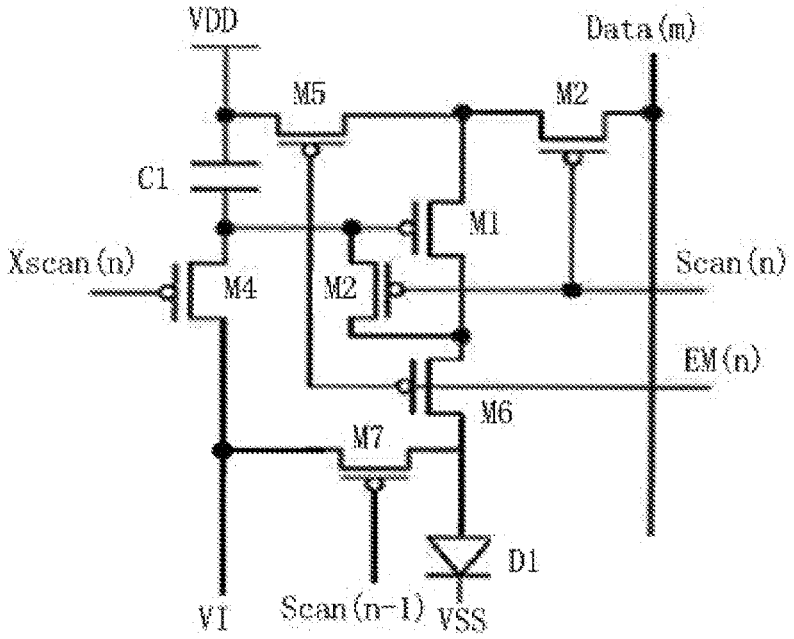
FIG. 1 is a circuit diagram of a current 7T1C internal compensation circuit.

Embodiments of the present application are described detailly below. Examples of the embodiments are shown in the drawings, and units of the same or similar functions are using the same or similar numeral to represent. Terms such as "first," "second," "third" (if any) in the specification, claims and forgoing drawings of the disclosure are only to distinguish similar objects, and are not used to describe specific sequence or order. It should be understood that, such terms can be interchanged as appropriate, and it is merely a way to distinguish objects having the same attributes in describing the embodiments of the disclosure. In the description of the present invention, it should be noted that, "a plurality of" means two or more than two. Furthermore, the terms "including" and "having" and any variations thereof are intended to cover non-exclusive inclusion. Directional terms mentioned in the present application, such as "top," "bottom," "left," "right," "front," "rear," "in," "out" only refer to directions in the accompanying drawings.

In the present application, unless otherwise specifically stated and defined, terms "connected", "fixed", etc. should be interpreted expansively. For example, "fixed" may be fixed connection, also may be detachable connection, or integration; may be mechanical connection, also may be electrical connection; may be direct connection, also may be indirect connection through an intermediate, and may be internal communication between two elements or interaction of two elements, unless otherwise specifically defined. The ordinary skill in this field can understand the specific implication of the above terms in the present disclosure according to specific conditions.

The present application proposes a novel 5T2C pixel compensation circuit, which adopts a double-gate structure transistor as a driving transistor. A double-gate device with two gates, which are a top gate (TG) and a bottom gate (BG), can respectively regulate channels to realize a dynamic adjustment of a threshold voltage (Vth) of a driving transistor. By electrically connecting transistors between the bottom gate and a drain of the driving transistor, the driving transistor can realize a diode-connect mode. By electrically connecting capacitors between the bottom gate and a source of the driving transistor, a voltage between the bottom gate and the source of the driving transistor can be stored. The present application combines a principle of gate control of a double-gate device and a principle of detecting the threshold voltage of a transistor adopting the diode-connect mode, which realizes real-time compensation of the threshold voltage and compensation of a positive drift and a negative drift of the threshold voltage. A range of the compensation of the threshold voltage is effectively broadened, and the compensation of the threshold voltage in different threshold voltage drifts under a same grayscale is realized, thereby effectively improving the uniformity of image display under the same grayscale and increasing service life of the panel display. Thin-film transistors (TFTs) in the 5T2C pixel compensation circuit can all be P-type TFTs (PTFTs), and their TFT structure and circuit implementation way are universal.

Figure 2:
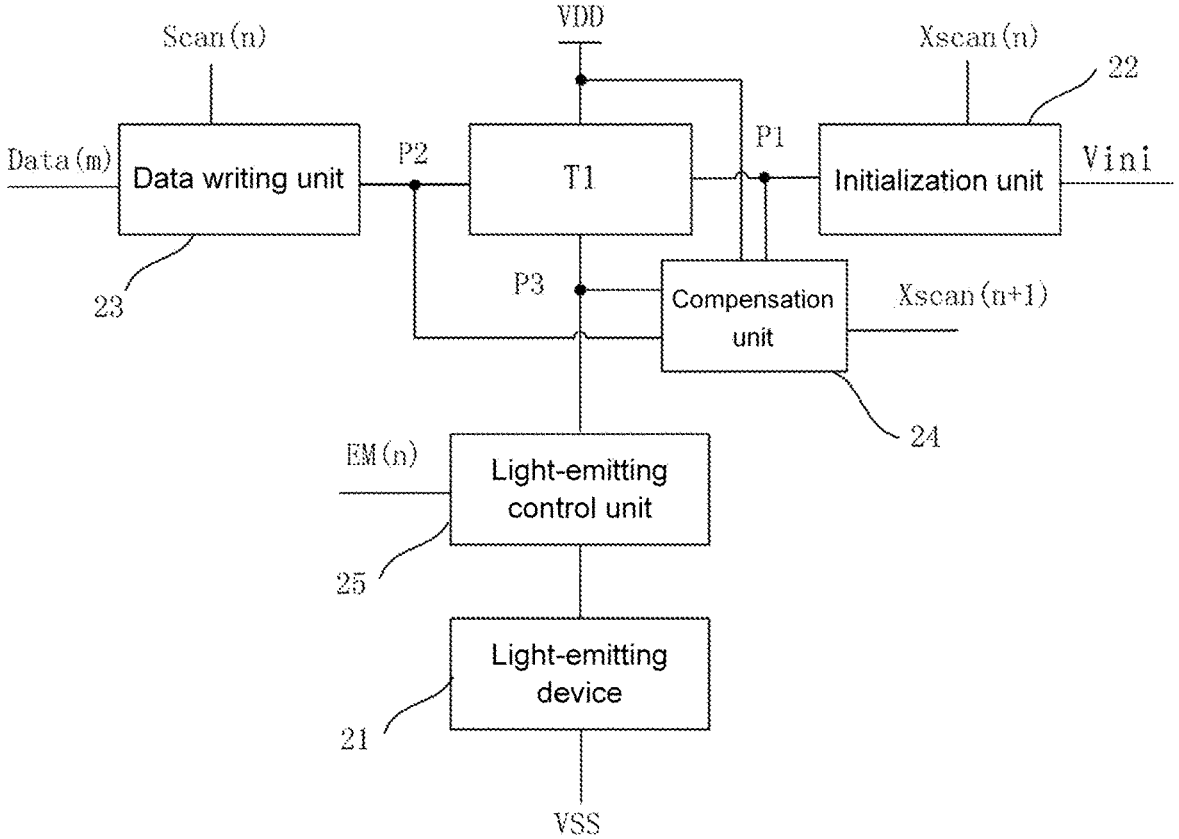
FIG. 2 is a structural diagram of a pixel compensation circuit of the present application.
Figure 3:
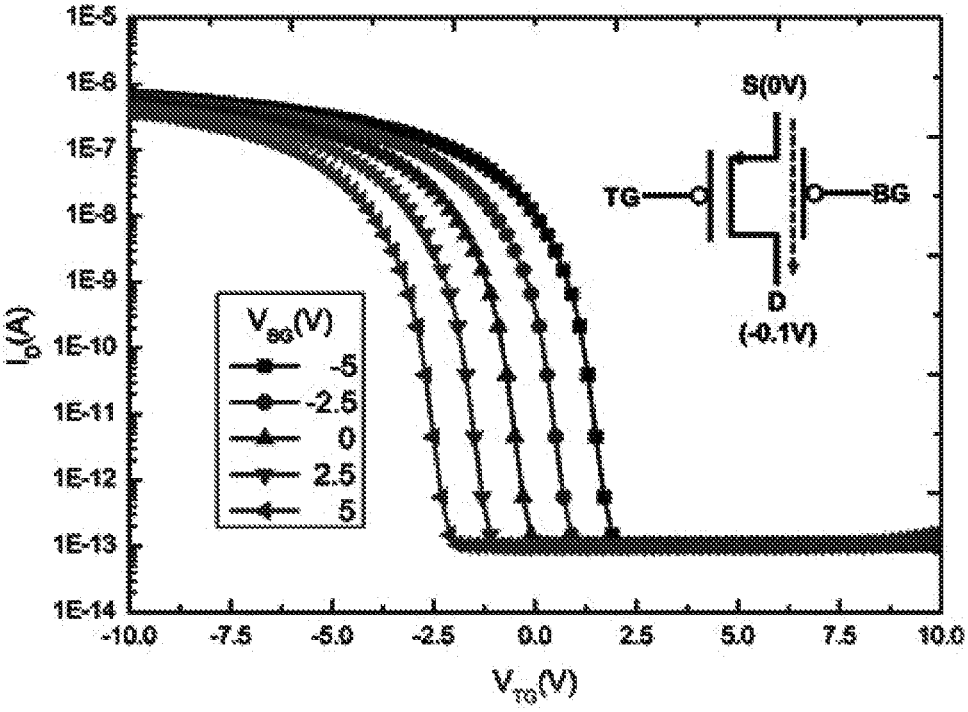
FIG. 3 is a gate modulation IV curve of a double-gate structure transistor.
Figure 4:
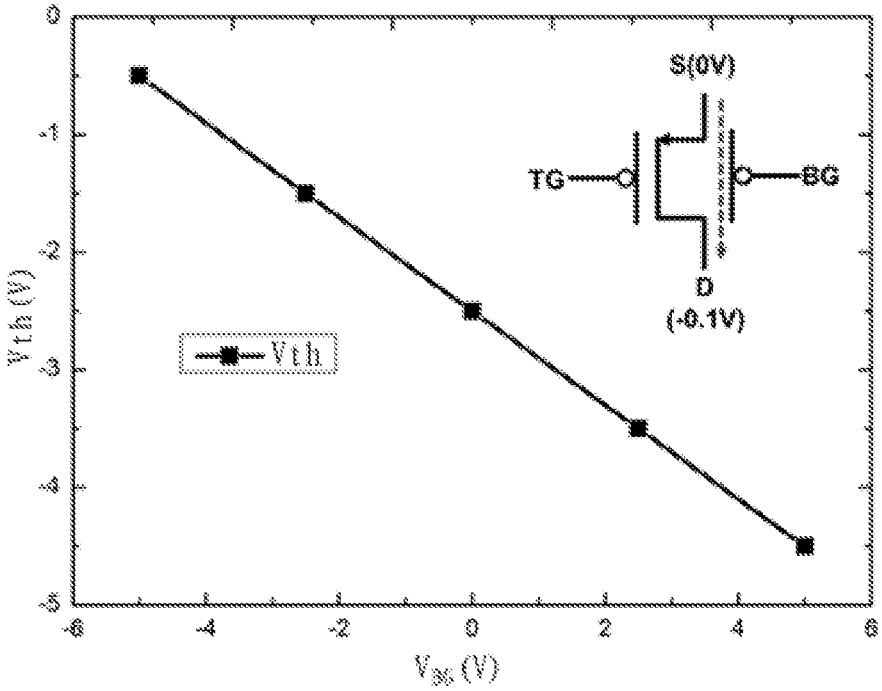
FIG. 4 is a modulation relationship curve between a threshold voltage of the double-gate structure transistor and a bottom gate voltage.
Figure 5:
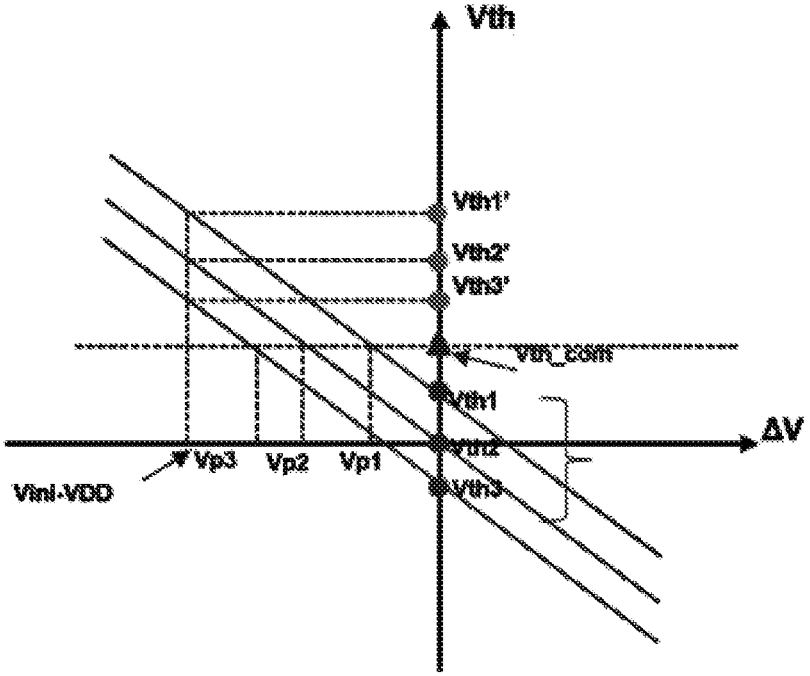
FIG. 5 is a diagram of a compensation principle of the double-gate structure transistor under different threshold voltage drift conditions.

Please refer to FIGS. 2 to 5. FIG. 2 is a structural diagram of the pixel compensation circuit of the present application. FIG. 3 is a gate modulation IV curve of a double-gate structure transistor. FIG. 4 is a modulation relationship curve between a threshold voltage of the double-gate structure transistor and a bottom gate voltage. FIG. 5 is a diagram of a compensation principle of the double-gate structure transistor under different threshold voltage drift conditions.

As shown in FIG. 2, the pixel compensation circuit of the present application includes a driving transistor T1 and a light-emitting device 21, and further includes an initialization unit 22, a data writing unit 23, a compensation unit 24, and a light-emitting control unit 25.

The driving transistor T1 adopts a double-gate structure, a bottom gate (BG) thereof is electrically connected to a first node P1, a top gate (TG) thereof is electrically connected to a second node P2, a first electrode thereof is configured to receive a driving voltage VDD, and a second electrode thereof is electrically connected to a third node P3. Specifically, the driving transistor T1 adopts a PTFT with the double-gate structure. The gate modulation IV curve of the double-gate structure transistor is shown in FIG. 3. A vertical coordinate is a top gate voltage $V_{TG}$ of the double-gate structure transistor, in volts (V), and a horizontal coordinate is a current $I_D$ of the double-gate structure transistor, in amps (A). The modulation relationship curve between the threshold voltage Vth of the double-gate structure transistor and the bottom gate voltage $V_{BG}$ is shown in FIG. 4.

The initialization unit 22 is electrically connected to the first node P1 for transmitting an initialization voltage Vini to the first node P1 during an initialization phase to adjust a threshold voltage Vth of the driving transistor T1 to a positive value. During the initialization phase, a signal of a previous frame can be refreshed by writing the initialization voltage Vini to the first node P1. At this time, because the bottom gate voltage of the driving transistor T1 is negative compared to the driving voltage VDD, its threshold voltage is modulated to a positive value.

The data writing unit 23 is electrically connected to the second node P2 for transmitting a reference voltage Vref to the second node P2 during a compensation phase and transmitting a data voltage Vdata to the second node P2 during a data writing phase. Specifically, the data writing unit 23 writes the reference voltage Vref to the driving transistor T1 during the compensation phase, and the data writing unit 23 writes the data voltage Vdata to the driving transistor T1 during the data writing phase.

The compensation unit 24 is respectively connected to the first node P1, the second node P2, the third node P3, and the first electrode of the driving transistor T1, and is configured to control the driving transistor T1 to form a diode-connect mode during the compensation phase to compensate the threshold voltage of the driving transistor T1 to a preset value according to the reference voltage Vref and the driving voltage VDD. Specifically, the data writing unit 23 writes the reference voltage Vref to the driving transistor T1 during the compensation phase. The driving transistor T1 forms the diode-connect mode, so that a voltage of the first node P1 is continuously raised, and the threshold voltage of the driving transistor T1 is gradually decreased until the driving transistor T1 is turned off. At this time, the threshold voltage of the driving transistor T1 is maintained at the preset value (Vref-VDD), which compensates the threshold voltage. In addition, when the driving transistor T1 is turned off, threshold voltages of all the transistors are modulated to the preset value, that is, the threshold voltages of all the transistors are written to a same value, thereby realizing the compensation of the threshold voltage under the same grayscale, and compensating a case that an initial value of the threshold voltage is a positive value.

The light-emitting control unit 25 is respectively electrically connected to the third node P3 and the light-emitting device 21 for controlling the light-emitting device 21 to emit light under driving of the driving transistor T1 during an emission phase.

As shown in FIG. 5, a vertical coordinate is the threshold voltage Vth of the double-gate structure transistor (driving transistor T1), and a horizontal coordinate is the compensation of the threshold voltage ΔV. Assume that Vth1-Vth3 are different initial values of the threshold voltage Vth of the driving transistor T1. During the initialization phase, the initialization voltage Vini is written to the bottom gate (BG) of the driving transistor T1, and the threshold voltage Vth of the driving transistor T1 is raised (to corresponding vertical coordinates Vth1'-Vth3', a corresponding horizontal coordinate Vini-VDD) through a gate control mechanism of the bottom gate of the double-gate device. During the compensation phase, the reference voltage Vref is written to the top gate (TG) of the driving transistor T1, the driving transistor T1 forms the diode-connect mode, and the bottom gate voltage is raised, so that the threshold voltage Vth of the driving transistor T1 is decreased. When the threshold voltages of all the TFTs are modulated to Vref-VDD (a corresponding vertical coordinate is Vth_com and corresponding horizontal coordinates are Vp3, Vp2, Vp1), the driving transistor T1 is turned off, so that the threshold voltages Vth of all the TFTs are written to the same value. Therefore, compensation of the threshold voltage Vth under the same grayscale is realized, and the case that the initial value of the threshold voltage Vth is positive can be compensated.

The pixel compensation circuit of the present application adopts the double-gate structure transistor as the driving transistor, so that the top gate and the bottom gate can respectively regulate channels to realize the dynamic adjustment of the threshold voltage of the driving transistor. Detection of the threshold voltage by the diode-connect mode can be realized by controlling the driving transistor. Real-time compensation of the threshold voltage can be realized, and compensation of a positive drift and a negative drift of the threshold voltage can also be realized. The range of the compensation of the threshold voltage is effectively broadened, and the compensation of the threshold voltage in different threshold voltage drifts under the same grayscale is realized, thereby effectively improving the uniformity of image display under the same grayscale and increasing service life of the panel display. In addition, a circuit structure of the pixel compensation circuit of the present application is simple and requires fewer TFTs, which facilitates in-plane integration.

Figure 6:
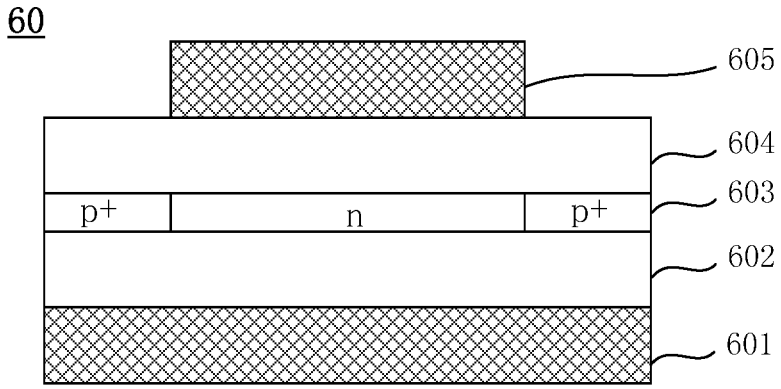
FIG. 6 is a structural diagram of film layers of a driving transistor of the present application.

Please refer to FIG. 6, which is a structural diagram of film layers of the driving transistor of the present application. Specifically, a film structure of the driving transistor 60 includes the bottom gate (BG) 601, a first gate dielectric layer (BGI) 602, a semiconductor layer 603, a second gate dielectric layer (TGI) 604, and the top gate (TG) 605 stacked in sequence. The top gate 605 and the bottom gate 601 can respectively regulate channels to realize the dynamic adjustment of the threshold voltage of the driving transistor.

In a further embodiment, the driving transistor 60 is a P-type thin-film transistor, the semiconductor layer 603 includes an N-type channel region and a P-type doped region formed on two sides of the N-type channel region.

In a further embodiment, the first gate dielectric layer 602 is a bottom gate dielectric layer and includes a stacked silicon oxide/silicon nitride structure (SiOx+SiNx). The second gate dielectric layer 604 is a top gate dielectric layer and includes a single-layer silicon oxide structure (SiOx).

Figure 7:
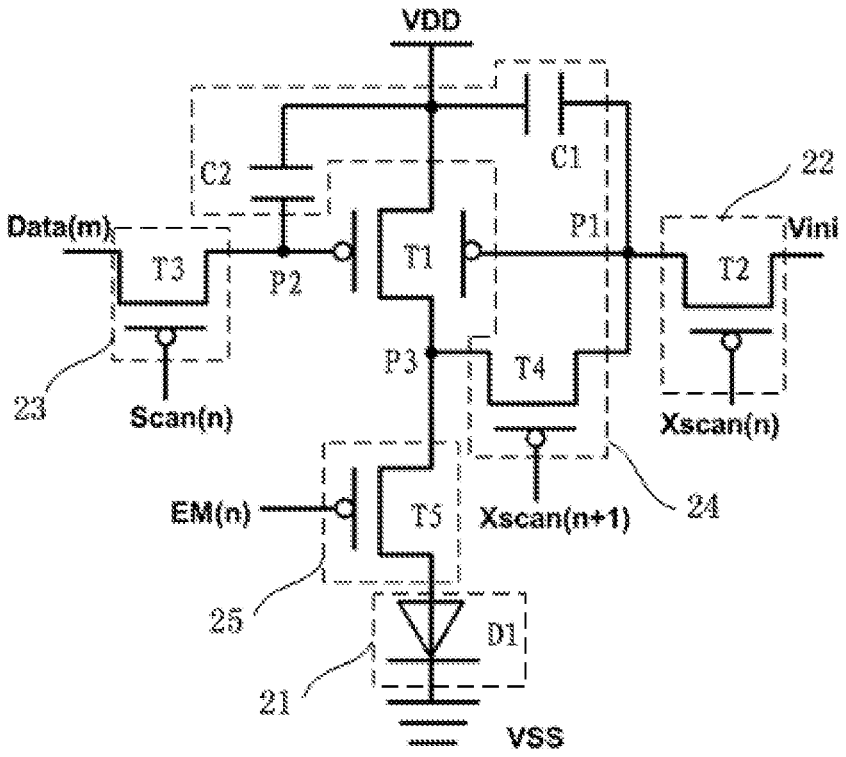
FIG. 7 is a circuit diagram of an embodiment of the pixel compensation circuit of the present application.
Figure 8:
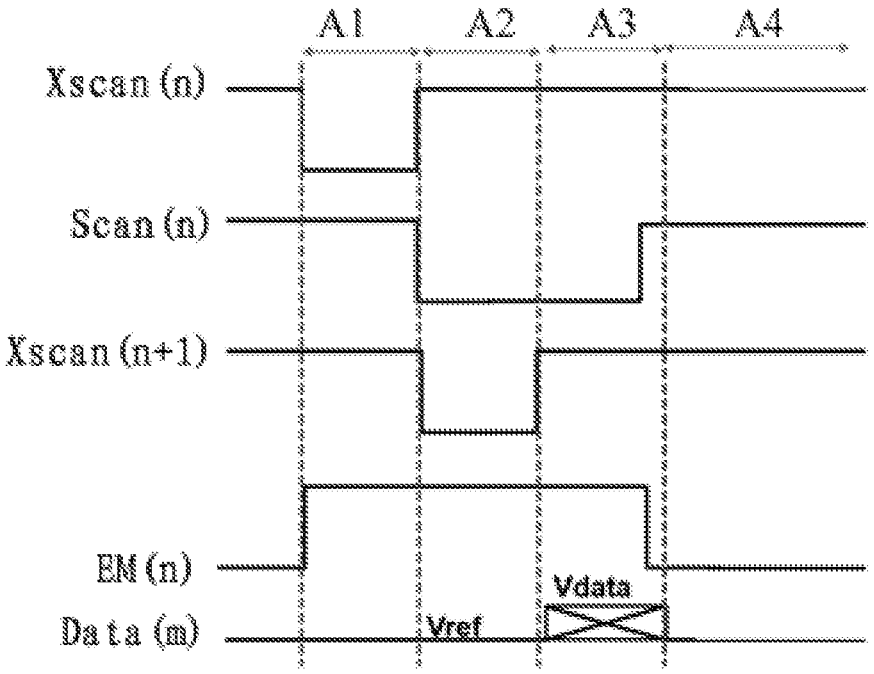
FIG. 8 is a driving timing diagram of the pixel compensation circuit shown in FIG. 7.

Please refer to FIGS. 2, 7, and 8. FIG. 7 is a circuit diagram of an embodiment of the pixel compensation circuit of the present application. FIG. 8 is a driving timing diagram of the pixel compensation circuit shown in FIG. 7.

As shown in FIG. 7, the pixel compensation circuit adopts the 5T2C pixel compensation circuit. The TFTs in the circuit all adopt P-type thin-film transistors (PTFTs). A source of the PTFT is a first electrode of a corresponding transistor, and a drain of the PTFT is a second electrode of a corresponding transistor. A TFT structure and a circuit implementation way of the 5T2C pixel compensation circuit are universal. The driving transistor T1 adopts a PTFT with the double-gate structure, and the light-emitting device adopts a photodiode D1.

Specifically, the initialization unit 22 includes a second transistor T2. A gate of the second transistor T2 is configured to receive a first scan signal Xscan(n), a first electrode thereof is configured to receive the initialization voltage Vini, and a second electrode thereof is electrically connected to the first node P1. The second transistor T2 is configured to be turned on in response to the first scan signal Xscan(n) and transmit the initialization voltage Vini to the first node P1.

Specifically, the data writing unit 23 includes a third transistor T3. A gate of the third transistor T3 is configured to receive a second scan signal scan(n), a first electrode thereof is configured to receive the reference voltage Vref during the compensation phase and receive the data voltage Vdata during the data writing phase, and a second electrode thereof is electrically connected to the second node P2. The third transistor T3 is configured to be turned on in response to the second scan signal scan(n), writes the reference voltage Vref to the driving transistor T1 during the compensation phase, and writes the data voltage Vdata to the driving transistor T1 during the data writing phase.

Specifically, the compensation unit 24 includes a fourth transistor T4, a first capacitor C1, and a second capacitor C2. A gate of the fourth transistor T4 is configured to receive a third scan signal Xscan(n+1), a first electrode thereof is electrically connected to the first node P1, and a second electrode thereof is electrically connected to the third node P3. The fourth transistor T4 is configured to be turned on in response to the third scan signal Xscan(n+1), forms the driving transistor T1 to the diode-connect mode, and raises the voltage of the first node P1 according to the reference voltage Vref. The first capacitor C1 is respectively electrically connected to the first electrode of the driving transistor T1 and the first node P1. The first capacitor C1 is configured to store the voltage of the first node P1, that is, the bottom gate voltage of the driving transistor T1 is stored. The second capacitor C2 is respectively electrically connected to the first electrode of the driving transistor T1 and the second node P2. The second capacitor C2 is configured to store a voltage of the second node P2, that is, the top gate voltage of the driving transistor T1 is stored. The third scan signal Xscan(n+1) is a next frame scan signal related to the first scan signal Xscan(n).

Specifically, the light-emitting control unit 25 includes a fifth transistor T5. A gate of the fifth transistor T5 is configured to receive a light-emitting control signal EM(n), a first electrode thereof is electrically connected to the third node P3, and a second electrode thereof is electrically connected to an anode of the photodiode D1. An upper cathode of the photodiode D1 is connected to a common voltage VSS. The fifth transistor T5 is configured to be turned on in response to the light-emitting control signal EM(n), and the driving transistor T1 drives the photodiode D1 to emit light. In a further embodiment, the photodiode D1 is an organic light-emitting diode (OLED).

A working principle of the pixel compensation circuit of the present application is further explained below with reference to FIGS. 7 and 8. A specific working principle is as follows:

Initialization phase A1: the light-emitting control signal EM(n) is at a high voltage level, and the fifth transistor T5 is turned off to prevent the photodiode D1 from emitting light. The second scan signal scan(n) and the third scan signal Xscan(n+1) are at a high voltage level, and the third transistor T3 and the fourth transistor T4 are turned off. The first scan signal Xscan(n) is at a low voltage level, the first transistor T1 is turned on, and the first node P1 is written the initialization voltage Vini to refresh a previous frame signal. At this time, because the bottom gate voltage of the driving transistor T1 is negative compared to the driving voltage VDD, the threshold voltage of the driving transistor T1 is modulated to a positive value.

Compensation phase A2: the first scan signal Xscan(n) is transformed to a high voltage level, and the first transistor T1 is turned off. The second scan signal scan(n) is transformed to a low voltage level, the third transistor T3 is turned on, the second node P2 is written the reference voltage Vref signal, and a corresponding voltage of the second node P2 is stored in the second capacitor C2. The third scan signal Xscan(n+1) is also transformed to a low voltage level, the fourth transistor T4 is also turned on, the driving transistor T1 forms a diode, the voltage of the first node P1 is continuously raised, and the threshold voltage of the driving transistor T1 is gradually decreased until it is turned off. At this time, the threshold voltage of the driving transistor T1 is maintained at the preset value (Vref-VDD), which compensates the threshold voltage, and a corresponding voltage of the first node P1 is stored in the first capacitor C1.

Data writing phase A3: the third scan signal Xscan(n+1) is transformed to a high voltage level, and the fourth transistor T4 is turned off. The second scan signal scan(n) is maintained at a low voltage level, the third transistor T3 is maintained on, and the second node P2 is written the data voltage Vdata signal.

Emission phase A4: the second scan signal scan(n) is transformed to a high voltage level, and the third transistor T3 is turned off. The light-emitting control signal EM(n) is transformed to a low voltage level, the fifth transistor T5 is turned on, and the photodiode D1 emits light.

Based on a same inventive concept, the present application also provides a display panel.

Figure 9:
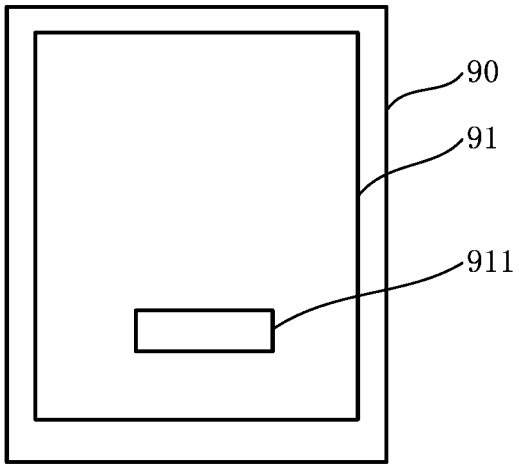
FIG. 9 is a structural diagram of a display panel of the present application.

Please refer to FIG. 9, which is a structural diagram of the display panel of the present application. The display panel 90 includes an array substrate 91. The array substrate 91 includes a pixel compensation circuit 911. The pixel compensation circuit adopts the pixel compensation circuit described in FIGS. 2 and 7 of the present application. A connection method and the working principle of circuit components of the pixel compensation circuit 911 have been described in detail, and are not described herein again.

The display panel which adopts the pixel compensation circuit of the present application can realize real-time compensation of the threshold voltage, and can also realize compensation of a positive drift and a negative drift of the threshold voltage. A range of the compensation of the threshold voltage is effectively broadened, and the compensation of the threshold voltage in different threshold voltage drifts under the same grayscale is realized, thereby effectively improving the uniformity of image display under the same grayscale and increasing service life of the panel display. In addition, a circuit structure of the pixel compensation circuit of the present application is simple and requires fewer TFTs, which facilitates in-plane integration.

Understandably, those having ordinary skills of the art may easily contemplate various changes and modifications of the technical solution and technical ideas of the present application and all these changes and modifications are considered within the protection scope of right for the present application.

What is claimed is:

1. A pixel compensation circuit, comprising a driving transistor and a light-emitting device, and further comprising an initialization unit, a data writing unit, a compensation unit, and a light-emitting control unit;

wherein the driving transistor comprises a P-type thin-film transistor with a double-gate structure, a bottom gate thereof is electrically connected to a first node, a top gate thereof is electrically connected to a second node, a first electrode thereof is configured to receive a driving voltage, and a second electrode thereof is electrically connected to a third node;

wherein the initialization unit is electrically connected to the first node for transmitting an initialization voltage to the first node during an initialization phase to adjust a threshold voltage of the driving transistor to a positive value;

wherein the data writing unit is electrically connected to the second node for transmitting a reference voltage to the second node during a compensation phase and transmitting a data voltage to the second node during a data writing phase;

wherein the compensation unit comprises a fourth transistor, a first capacitor, and a second capacitor;

wherein a gate of the fourth transistor is configured to receive a third scan signal, a first electrode thereof is electrically connected to the first node, and a second electrode thereof is electrically connected to the third node;

wherein the first capacitor is respectively electrically connected to the first electrode of the driving transistor and the first node, and the second capacitor is respectively electrically connected to the first electrode of the driving transistor and the second node;

wherein the compensation unit is configured to control the driving transistor to form a diode-connect mode during the compensation phase to compensate the threshold voltage of the driving transistor to a preset value according to the reference voltage and the driving voltage; and wherein the light-emitting control unit is respectively electrically connected to the third node and the light-emitting device for controlling the light-emitting device to emit light under driving of the driving transistor during an emission phase.

2. The pixel compensation circuit as claimed in claim 1, wherein a film structure of the driving transistor comprises the bottom gate, a first gate dielectric layer, a semiconductor layer, a second gate dielectric layer, and the top gate stacked in sequence.

3. The pixel compensation circuit as claimed in claim 2, wherein the semiconductor layer comprises an N-type channel region and a P-type doped region formed on two sides of the N-type channel region.

4. The pixel compensation circuit as claimed in claim 2, wherein the first gate dielectric layer comprises a stacked silicon oxide/silicon nitride structure, and the second gate dielectric layer comprises a single-layer silicon oxide structure.

5. The pixel compensation circuit as claimed in claim 1, wherein the fourth transistor is a P-type thin-film transistor.

6. The pixel compensation circuit as claimed in claim 1, wherein the light-emitting device comprises an organic light-emitting diode.

7. The pixel compensation circuit as claimed in claim 1, wherein the initialization unit comprises a second transistor; and a gate of the second transistor is configured to receive a first scan signal, a first electrode thereof is configured to receive the initialization voltage, and a second electrode thereof is electrically connected to the first node.

8. The pixel compensation circuit as claimed in claim 1, wherein the data writing unit comprises a third transistor; and a gate of the third transistor is configured to receive a second scan signal, a first electrode thereof is configured to receive the reference voltage during the compensation phase and receive the data voltage during the data writing phase, and a second electrode thereof is electrically connected to the second node.

9. The pixel compensation circuit as claimed in claim 1, wherein the light-emitting control unit comprises a fifth transistor; and a gate of the fifth transistor is configured to receive a light-emitting control signal, a first electrode thereof is electrically connected to the third node, and a second electrode thereof is electrically connected to the light-emitting device.

10. A pixel compensation circuit, comprising a driving transistor and a light-emitting device, and further comprising an initialization unit, a data writing unit, a compensation unit, and a light-emitting control unit;

wherein the driving transistor comprises a double-gate structure, a bottom gate thereof is electrically connected to a first node, a top gate thereof is electrically connected to a second node, a first electrode thereof is configured to receive a driving voltage, and a second electrode thereof is electrically connected to a third node;

wherein the initialization unit is electrically connected to the first node for transmitting an initialization voltage to the first node during an initialization phase to adjust a threshold voltage of the driving transistor to a positive value;

wherein the data writing unit is electrically connected to the second node for transmitting a reference voltage to the second node during a compensation phase and transmitting a data voltage to the second node during a data writing phase;

wherein the compensation unit is respectively electrically connected to the first node, the second node, the third node, and the first electrode of the driving transistor for controlling the driving transistor to form a diode-connect mode during the compensation phase to compensate the threshold voltage of the driving transistor to a preset value according to the reference voltage and the driving voltage; and wherein the light-emitting control unit is respectively electrically connected to the third node and the light-emitting device for controlling the light-emitting device to emit light under driving of the driving transistor during an emission phase.

11. The pixel compensation circuit as claimed in claim 10, wherein the driving transistor comprises a P-type thin-film transistor with a double-gate structure.

12. The pixel compensation circuit as claimed in claim 10, wherein the light-emitting device comprises an organic light-emitting diode.

13. The pixel compensation circuit as claimed in claim 10, wherein a film structure of the driving transistor comprises the bottom gate, a first gate dielectric layer, a semiconductor layer, a second gate dielectric layer, and the top gate stacked in sequence.

14. The pixel compensation circuit as claimed in claim 13, wherein the semiconductor layer comprises an N-type channel region and a P-type doped region formed on two sides of the N-type channel region.

15. The pixel compensation circuit as claimed in claim 13, wherein the first gate dielectric layer comprises a stacked silicon oxide/silicon nitride structure, and the second gate dielectric layer comprises a single-layer silicon oxide structure.

16. The pixel compensation circuit as claimed in claim 10, wherein the initialization unit comprises a second transistor; and a gate of the second transistor is configured to receive a first scan signal, a first electrode thereof is configured to receive the initialization voltage, and a second electrode thereof is electrically connected to the first node.

17. The pixel compensation circuit as claimed in claim 10, wherein the data writing unit comprises a third transistor; and a gate of the third transistor is configured to receive a second scan signal, a first electrode thereof is configured to receive the reference voltage during the compensation phase and receive the data voltage during the data writing phase, and a second electrode thereof is electrically connected to the second node.

18. The pixel compensation circuit as claimed in claim 10, wherein the compensation unit comprises a fourth transistor, a first capacitor, and a second capacitor;

a gate of the fourth transistor is configured to receive a third scan signal, a first electrode thereof is electrically connected to the first node, and a second electrode thereof is electrically connected to the third node; and the first capacitor is respectively electrically connected to the first electrode of the driving transistor and the first node, and the second capacitor is respectively electrically connected to the first electrode of the driving transistor and the second node.

19. The pixel compensation circuit as claimed in claim 10, wherein the light-emitting control unit comprises a fifth transistor; and a gate of the fifth transistor is configured to receive a light-emitting control signal, a first electrode thereof is electrically connected to the third node, and a second electrode thereof is electrically connected to the light-emitting device.

20. A display panel, comprising an array substrate;

wherein the array substrate comprises a pixel compensation circuit;

wherein the pixel compensation circuit comprises a driving transistor and a light-emitting device, and further comprises an initialization unit, a data writing unit, a compensation unit, and a light-emitting control unit;

wherein the driving transistor comprises a double-gate structure, a bottom gate thereof is electrically connected to a first node, a top gate thereof is electrically connected to a second node, a first electrode thereof is configured to receive a driving voltage, and a second electrode thereof is electrically connected to a third node;

wherein the initialization unit is electrically connected to the first node for transmitting an initialization voltage to the first node during an initialization phase to adjust a threshold voltage of the driving transistor to a positive value;

wherein the data writing unit is electrically connected to the second node for transmitting a reference voltage to the second node during a compensation phase and transmitting a data voltage to the second node during a data writing phase;

wherein the compensation unit is respectively electrically connected to the first node, the second node, the third node, and the first electrode of the driving transistor for controlling the driving transistor to form a diode-connect mode during the compensation phase to compensate the threshold voltage of the driving transistor to a preset value according to the reference voltage and the driving voltage; and wherein the light-emitting control unit is respectively electrically connected to the third node and the light-emitting device for controlling the light-emitting device to emit light under driving of the driving transistor during an emission phase.

* * * * *